United States Patent [19]

Sherwood et al.

[11] 4,157,074

[45] Jun. 5, 1979

[54] WATER JET PROPULSION DEVICE

[76] Inventors: Roy A. Sherwood; Patricia E. Sherwood, both of 8424 Ranchito Ave., Panorama City, Calif. 91402

[21] Appl. No.: 880,620

[22] Filed: Feb. 23, 1978

Related U.S. Application Data

[63] Continuation of Ser. No. 795,414, May 9, 1977, abandoned, which is a continuation of Ser. No. 655,478, Feb. 5, 1976, abandoned.

[51] Int. Cl.[2] ..... B63H 11/00

[52] U.S. Cl. ..... 115/12 A; 115/11

[58] Field of Search ..... 115/11, 12 R, 12 A, 115/14, 15, 16, 21, 28 R, 30, 31, 33; 239/265.19, 265.33, 514, 515, 499, 507; 60/221, 228, 230; 114/162; 272/1 B; 248/4; 46/95

[56] References Cited

U.S. PATENT DOCUMENTS

| | | | |
|---|---|---|---|
| 119,363 | 9/1871 | Jackson | 115/14 |
| 3,003,455 | 10/1961 | Alexander et al. | 115/12 R |
| 3,142,285 | 7/1964 | Sorrentino et al. | 115/12 R |
| 3,173,397 | 3/1965 | Beard | 115/12 A |
| 3,372,667 | 3/1968 | Sweet | 115/12 A |
| 3,408,975 | 11/1968 | Gamble | 115/12 A |

*Primary Examiner*—Charles E. Frankfort
*Attorney, Agent, or Firm*—Allan M. Shapiro

[57] ABSTRACT

Water jet propulsion unit is attachable to a floating structure and propels the structure by discharging water laterally out of jet under water level. In the rest position, the jet is shrouded so that net thrust is downward and, when activated, the jet is discharged laterally into the water. Net thrust is controlled by control of the vertical angle of the jet into the water.

9 Claims, 4 Drawing Figures

Fig. 1
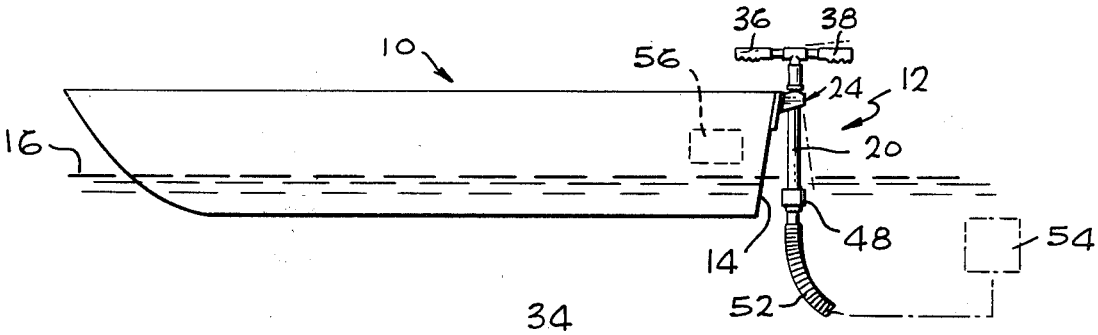
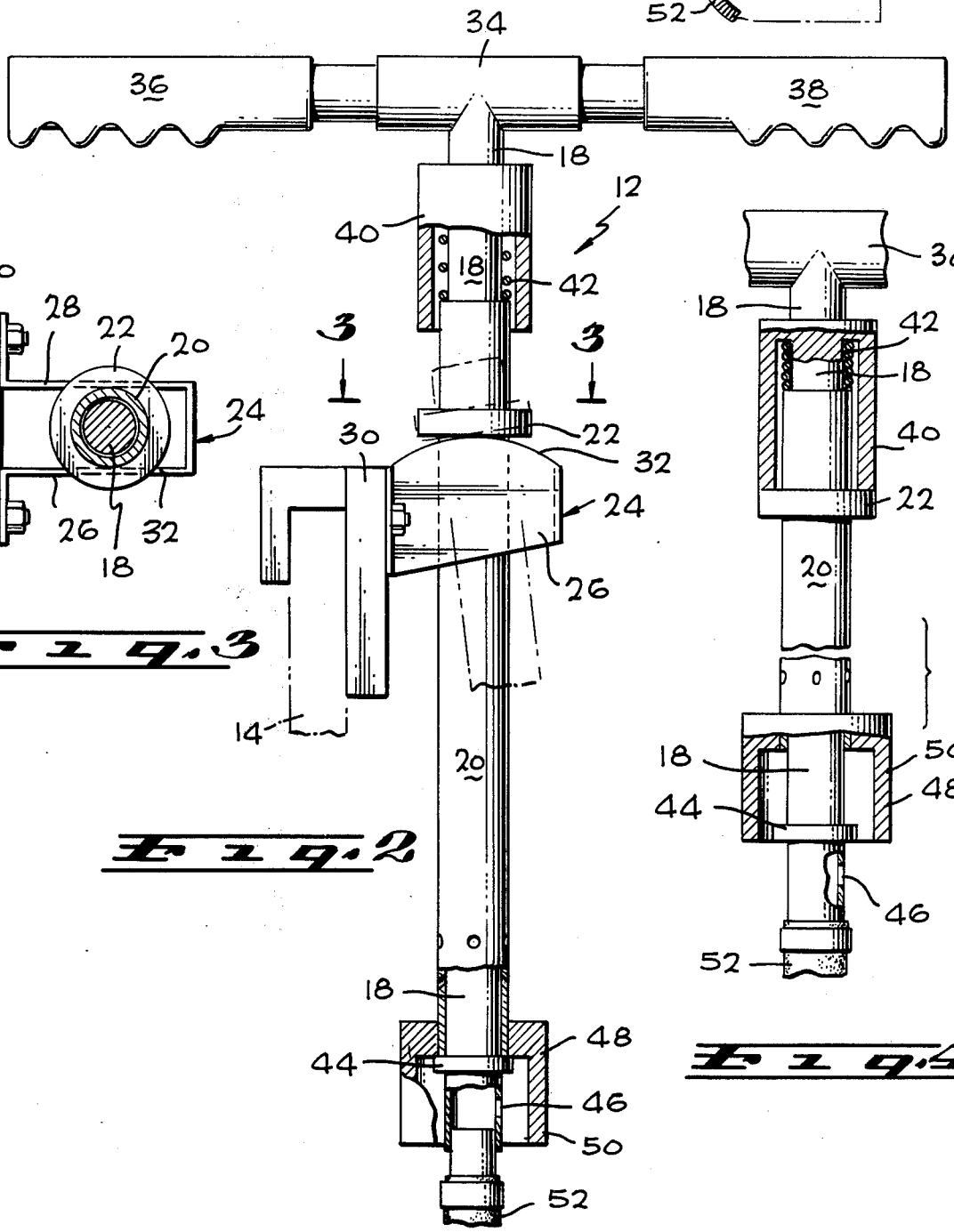
Fig. 3
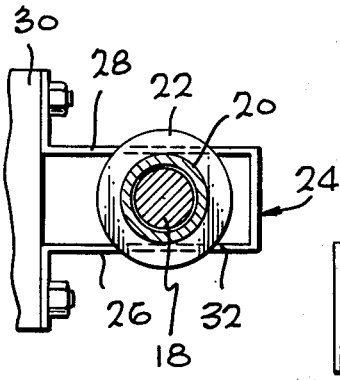
Fig. 2
Fig. 4

WATER JET PROPULSION DEVICE

This is a continuation application of Ser. No. 795,414, filed May 9, 1977, now abandoned, which application Ser. No. 795,414 is a continuation application of Ser. No. 655,478 filed Feb. 5, 1976, now abandoned.

BACKGROUND OF THE INVENTION

1. Field of the Invention

This invention is directed to a water jet propulsion device for attachment to a floating structure to provide controllable thrust, with the thrust being supplied by a source of water under pressure.

2. Description of the Prior Art

The propulsion of floating structures, such as boats, takes several forms. Nearly all of the forms provide thrust between the surrounding medium and the boat, some with propellers operating against air or water, and some by directing a water jet from the boat, either above or below the water level. Some of these devices are very sophiscated for the propulsion of high-speed boats. The present device is simple and can be applied to small boats for their propulsion in small waters.

One of the prior devices is taught by Sorrentino in U.S. Pat. No. 3,142,285. This is a simple boat with propulsion from a separate source of water under pressure, but the Sorrentino device is an integral structure of boat and propulsion units. The boat and propulsion units are inextricably interrelated and serve only as a combined device. There is no separate propulsion unit which is useful to attach to and propel other floating structures. Thus, the Sorrentino structure is very limited in its utility and in its teaching.

SUMMARY OF THE INVENTION

In order to aid in the understanding of this invention, it can be stated in essentially summary form that it is directed to a water jet propulsion device which is attachable to a floating structure. The device has an attachment bracket which engages a generally upright control shaft which is supplied with water under pressure and has a side jet. A shroud is positioned to obstruct the jet from the orifice and direct it downward. Control of the control shaft moves the shroud out of the way to obtain active thrust and to control the direction of the active thrust.

It is thus an object of this invention to provide a water jet propulsion device which can be attached to a floating structure for the propulsion of the floating structure. It is another object to provide a water jet propulsion device which is attachable to a source of water under pressure, with continuous flow of the water out of a thrust orifice, but with the thrust orifice positioned inside of a shroud to direct the water thrust downwardly when no forward thrust is desired. It is another object to provide a water jet propulsion device which can be operated to control the net thrust of the device by controlling the direction of the propulsion jet issuing from the orifice in a vertical angle.

The features of the present invention which are believed to be novel are set forth with particularity in the appended claims. The present invention, both as to its organization and manner of operation, and together with further advantages thereof, may be understood best by reference to the following description taken in conjunction with the accompanying drawings.

BRIEF DESCRIPTION OF THE DRAWINGS

FIG. 1 is a side elevational view of the water jet propulsion device of this invention shown attached to a floating structure in the form of a small boat.

FIG. 2 is an enlarged side elevational view of the device, with parts broken away and parts shown in section showing the device in the non-thrust position.

FIG. 3 is a section taken generally along the line 3—3 of FIG. 2.

FIG. 4 is a view similar to FIG. 2, with parts broken away, and showing the device in the position wherein the jet produces a forward thrust on the floating structure.

DESCRIPTION OF THE PREFERRED EMBODIMENT

FIG. 1 illustrates a floating structure 10 in the form of a small boat with the water jet propulsion device 12 of this invention attached to the transom 14 thereof. Propulsion device 12 is especially useful for the propulsion of small boats for play or training, and thus the body of water 16 in which the floating structure 10 is shown as being located may be a swimming pool or other fairly small body of water.

Device 12 comprises central tube 18 which may be closed near its top, which is mounted in tubular sleeve 20. The central tube 18 is axially movable within sleeve 20. As is seen in FIGS. 2 and 3, stop collar 22 is secured on the exterior of tubular sleeve 20. Mounting yoke 24 is U-shaped and has its side arms 26 and 28 flanged outwardly at their forward end and secured to mounting bracket 30. Mounting bracket 30 can be secured by any convenient means to the floating structure such as, for example, on transom 14, as shown in FIG. 2. Clamps, through-bolts, or other convenient securing means can alternatively be used.

As is seen in FIGS. 2 and 3, side arms 26 and 28 are spaced so that tubular sleeve 20 passes therebetween. Stop collar 22 engages on the top of the side arms and, as is especially seen in FIG. 2, the tops of the side arms are curved as on arc 32. Stop collar 22 engages on top of the curved arc surfaces 32 of mounting unit 24. The front-to-back length of opening between the arms of the mounting yoke is sufficient to permit sleeve 20 to be tilted a substantial amount, even much farther than shown in the dotted line position in FIGS. 1 and 2. Thus, tilting in a front-to-back angle is possible, and the curvature on arc 32 aids in swinging sleeve 20 and central tube 18 therein to a tilted position.

The upper end of central tube 18 carries tee 34, into which are secured forward control handle 36 and reverse control handle 38. Preferably, these control handles are color-coded with forward control handle 36 being colored blue and the reverse control handle 38 being colored red to distinguish therebetween.

Below tee 34, central tube 18 carries a combination structure which serves as a spring stop and spring cover. The stop-cover structure 40 is secured to central tube 18 to cover spring 42. Spring 42 engages on the top of tubular sleeve 20 and beneath the upper part of the stop-cover structure 40 to urge central tube 18 in the upward direction with respect to its outer tubular sleeve 20. The upper stop position shown in FIG. 2 is determined by stop 44 which is secured to the lower end of tube 18 engaging against the bottom of tubular sleeve 20.

Central tube 18 is vertically slidable within tubular sleeve 20 from the upper stop position shown in FIG. 2 to the lower stop position shown in FIG. 4. Jet orifice 46 is formed in the side of central tube 18 adjacent its lower end. Shroud 48, which can be considered a control sleeve, is in the form of an inverted cup. Shroud 48 has its upper, closed end secured to the lower end of tubular sleeve 20 directly at its lower end and in line therewith so that stop 44 engages against both the lower end of sleeve 20 and the interior surface of shroud 48, when the spring 42 is permitted to thrust control tube 18 upward. In this position, jet orifice 46 is located within the cylindrical, tubular sidewalls 50 of shroud 48. The shroud is open downward in this position. Shroud 48 is dimensioned and jet orifice 46 is positioned so that, when central tube 48 is thrust downward to its lower stop position, as shown in FIG. 4, jet orifice 46 is positioned below the shroud.

Hose 52, see FIGS. 1, 2 and 4, is connected to a supply 54 of water under pressure. The supply 54 can be any supply of water at convenient flow and pressure, and a garden hose serves as a suitable supply. In some applications, a special pump may be used to supply the necessary water. In some swimming pool installations, a pump of sufficiently high pressure and volume is available, such as the filter pump, and that pump can serve as water supply. When a special supply of water under pressure is employed to power the device of this invention, the supply can alternately be located within floating structure 10, as illustrated by supply 56 in FIG. 1.

When in operation, the supply of water under pressure pumps water to the interior of tube 18 and the only outlet from tube 18 is jet orifice 46. The character of the orifice is arranged for maximum thrust in accordance with the pressure and flow available. When the device is not actuated, spring 42 holds central tube 18 in the upper position wherein jet orifice 46 discharges water only interiorly of shroud 48 so that all of the water flow is directed downward by shroud 48, so there is no net forward thrust on floating structure 10. Under these circumstances, floating structure 10 is not propelled, and floats at random in the body of water 16.

When a user is on floating structure 10, he presses down upon one or the other of the operating handles 36 and 28. When forward operating handle 36 is pointed in the forward direction of structure 10, then orifice 46 is directed rearward, and pressing down on the handle causes the orifice 46 to be depressed below shroud 48 so that it thrusts into the body of water to cause forward propulsion of the floating structure. The direction of thrust is controlled by turning control handle 36 to control the direction of thrust. The net amount of thrust is controlled by tilting of tube 18 because, with tilting, only the component of thrust in the horizontal direction is available to provide propulsion in the horizontal direction. With central tube 18 in the upright direction of FIG. 2, thrust is maximum. When it is tilted at the maximum angle off of vertical permitted by mounting yoke 24, the forward thrust is minimized. "Reverse" is accomplished by turning handle 38 in the forward direction so that the thrust from jet orifice 46 is in the forward direction. Thus, full navigational control is available. Upon release of the control handle, spring 42 returns tube 18 to its upper position where jet orifice 46 is within shroud 48 so that there is no further net forward thrust. By this structure, a convenient, economic, and fully controllable water jet propulsion device is produced which can be attached to any convenient type of floating structure.

The continuous flow of water from jet orifice 46, as contrasted to turning it off, is necessary because the pool pumping equipment employed as a supply of water under pressure must flow constantly, since the pumping structure supply must have flow to cool the pump and prevent overheating. In the case where the present device is used in an open body of water, then the supply 56 can be portable water pump supply which can be powered by a battery-operated electric pump for use on those bodies of waters where gasoline engines are not permitted.

This invention having been described in its preferred embodiment, it is clear that it is susceptible to numerous modifications and embodiments by those skilled in the art and without the exercise of the inventive faculty. Accordingly, the scope of this invention is defined by the scope of the following claims.

What is claimed is:

1. A water jet propulsion device comprising:

a central tube, a jet orifice in said central tube for radially emitting a water jet;

means for attaching a flexible hose to said central tube for continuously supplying water under pressure to said central tube for continuous discharge from said jet orifice; and a cup-shaped shroud having sidewalls which surround said central tube and are spaced therefrom in the region of said jet orifice a distance sufficient to assure unrestricted full flow of water from said jet orifice at all times and positions, said central tube being rotatably and axially movably mounted with respect to said shroud so that said central tube can be moved into a non-propulsion first position, wherein the full flow out of said jet orifice is discharged against said shroud and said shroud axially redirects said full flow out of said jet orifice generally downwardly along the length of said central tube, and to a propulsion second position wherein said shroud is in non-interfering relationship with respect to flow out of said jet orifice to permit unrestricted water jet flow in the radial direction for propulsion.

2. The device of claim 1 wherein a tubular sleeve is mounted around said central tube, said tubular sleeve having mounting means thereon for removable attachment of said device to a floating structure for the propulsion thereof, said shroud being mounted on said tubular sleeve and said central tube being movably mounted with respect to said tubular sleeve so that said central tube can be moved into said first and second positions.

3. The device of claim 2 wherein a spring is interengaged between said central tube and said tubular sleeve to urge said central tube toward one of said positions of said central tube with respect to said tubular sleeve.

4. The device of claim 3 wherein first and second means are provided for interengagement between said central tube and said tubular sleeve to limit relative motion of said central tube with respect to said tubular sleeve between said first and second positions.

5. The device of claim 4 wherein a handle is attached to said central tube for controlling the rotative position of said central tube to control the direction of thrust of water from said jet orifice and to control the axial position of said central tube with respect to said tubular sleeve.

6. The device of claim 5 wherein there are first and second handles mounted on said central tube, said first and second handles being separately identifiable so that the direction of the jet orifice can be determined.

7. The device of claim 6 wherein said mounting means for mounting said central tube with respect to a floating structure includes a mounting yoke having an opening therethrough for receipt of said central tube, said opening being larger than said central tube so that said central tube can be tilted to control the vertical angle direction of thrust of said jet orifice.

8. The device of claim 2 wherein said mounting means for mounting said central tube with respect to a floating structure includes a mounting yoke having an opening therethrough for receipt of said central tube, said opening being larger than said central tube so that said central tube can be tilted to control the vertical angle direction of thrust of said jet orifice.

9. The device of claim 8 wherein said mounting yoke has first and second spaced side arms with said central tube extending therethrough and a stop on said central tube engaging said side arms, said side arms having a convexly curved arcuate top surface against which said stop collar engages so that tilting of said central tube with respect to said mounting bracket is facilitated to control the net forward propulsion thrust of water emitted from said jet orifice.

* * * * *